US010671017B2

(12) United States Patent
Takiguchi

(10) Patent No.: US 10,671,017 B2
(45) Date of Patent: Jun. 2, 2020

(54) IMAGE FORMING APPARATUS

(71) Applicant: CANON KABUSHIKI KAISHA, Tokyo (JP)

(72) Inventor: Masatoshi Takiguchi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/406,187

(22) Filed: May 8, 2019

(65) Prior Publication Data

US 2019/0354066 A1 Nov. 21, 2019

(30) Foreign Application Priority Data

May 18, 2018 (JP) ..... 2018-096163

(51) Int. Cl.
*G03G 15/08* (2006.01)
*G03G 21/18* (2006.01)

(52) U.S. Cl.
CPC ..... *G03G 21/1842* (2013.01); *G03G 21/1814* (2013.01)

(58) Field of Classification Search
CPC ..... G03G 21/1842; G03G 21/1814
See application file for complete search history.

(56) References Cited

U.S. PATENT DOCUMENTS 9,429,903 B2 8/2016 Sato
2017/0160697 A1* 6/2017 Sato ..... G03G 21/1633

FOREIGN PATENT DOCUMENTS

JP H09-190058 A 7/1997
JP 2000-132014 A 5/2000
JP 2014-106499 A 6/2014
JP 2015-197517 A 11/2015

* cited by examiner

*Primary Examiner* — David M. Gray
*Assistant Examiner* — Michael A Harrison
(74) *Attorney, Agent, or Firm* — Venable LLP

(57) ABSTRACT

An image forming apparatus includes a cartridge including a developing member mountable in and dismountable from a main assembly in a direction crossing a rotational axis direction of the developing member. A grip portion of the cartridge extends in a direction along a dismounting direction of the cartridge from the main assembly in a state in which the cartridge is mounted in the main assembly. An openable member in the main assembly includes a guiding portion to support the cartridge from below and guide the cartridge while the cartridge is being dismounted from the main assembly, with the guiding portion including a guiding surface having a downwardly recessed shape on a cross-section perpendicular to the rotational axis direction and guiding the cartridge so that an extending direction of the grip portion approaches a vertical direction as the cartridge is moved in the dismounting direction.

6 Claims, 14 Drawing Sheets

IMAGE FORMING APPARATUS

FIELD OF THE INVENTION AND RELATED ART

The present invention relates to an image forming apparatus, such as a copying machine, a printer or a facsimile machine, employing an electrophotographic type.

Conventionally, in an image forming apparatus using an electrophotographic image forming process, a cartridge type in which a cartridge is mounting in and dismountable from an image forming apparatus main assembly has been employed.

Further, a front door shown in FIG. 13 is provided openably in the image forming apparatus main assembly and is opened and closed, for example, during exchange of a developing cartridge 7 as the cartridge and during jam clearance.

On the other hand, in order to reduce an installation space of the image forming apparatus, it is desirable that a height of the image forming apparatus main assembly is reduced. In Japanese Laid-Open Patent Application (JP-A) 2015-197517, the developing cartridge 7 is made thin and a grip portion 7*b* of the developing cartridge 7 is extended, so that the height of the image forming apparatus main assembly is reduced.

However, in a conventional example, in a process in which a user supporting a main body portion of the developing cartridge by holding a long grip portion of the developing cartridge pulls out (discharges) the developing cartridge from the image forming apparatus main assembly, there was a possibility that the user drops the developing cartridge 7.

That is, FIG. 14 is a sectional view showing the process in which the user pulls out the developing cartridge 7 from the image forming apparatus main assembly, but the developing cartridge 7 is pulled out in a direction of P1, P2 and P3 in FIG. 14. In that case, when the developing cartridge 7 is separated from the developing cartridge 7, the developing cartridge 7 rotates in a direction from P3 to P4. There was a possibility that the user who does not predict an operation from P3 to P4 drops the developing cartridge 7.

SUMMARY OF THE INVENTION

According to an aspect of the present invention, there is provided an image forming apparatus comprising: a photosensitive member configure to carry a toner image; a cartridge including a developing member configured to supply toner to the photosensitive member, a frame configured to support the developing member so that the developing member is rotatable, and a grip portion provided on the frame; and a main assembly configured so that the cartridge is mountable in and dismountable from the main assembly in a direction crossing a rotational axis direction of the developing member, wherein the main assembly includes an opening through which the cartridge passes when the cartridge is mounted in and dismounted from the main assembly and includes an openable member movable between an open position where the opening is open and a closing position where the opening is closed, wherein the grip portion extends from the frame along a dismounting direction in which the cartridge is dismounted from the main assembly, wherein the openable member includes a guiding portion configured to guide the cartridge when the openable member is in the open position and the cartridge is dismounted from the main assembly, and wherein the guiding portion includes a guiding surface configured to guide the frame of the cartridge so that an extending direction of the grip portion approaches a vertical direction with movement of the cartridge in the dismounting direction.

Further features of the present invention will become apparent from the following description of exemplary embodiments with reference to the attached drawings.

DESCRIPTION OF EMBODIMENTS

Embodiments of the present invention will be specifically described with reference to the attached drawings.

First Embodiment (Image Forming Apparatus and Cartridge)

Figure 1:
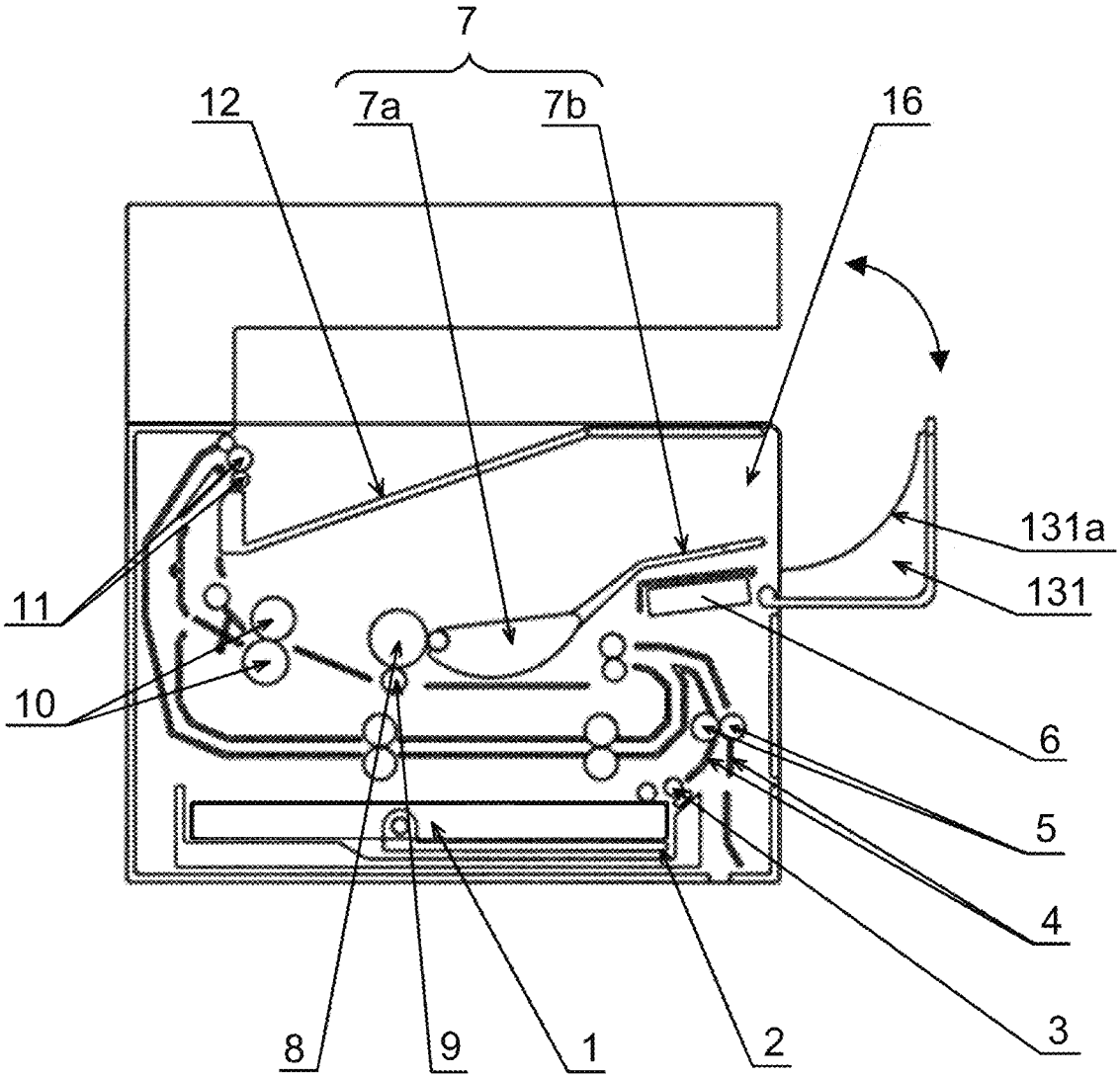
FIG. 1 is a sectional view showing a general structure of an image forming apparatus according to a First Embodiment of the present invention.
Figure 3:
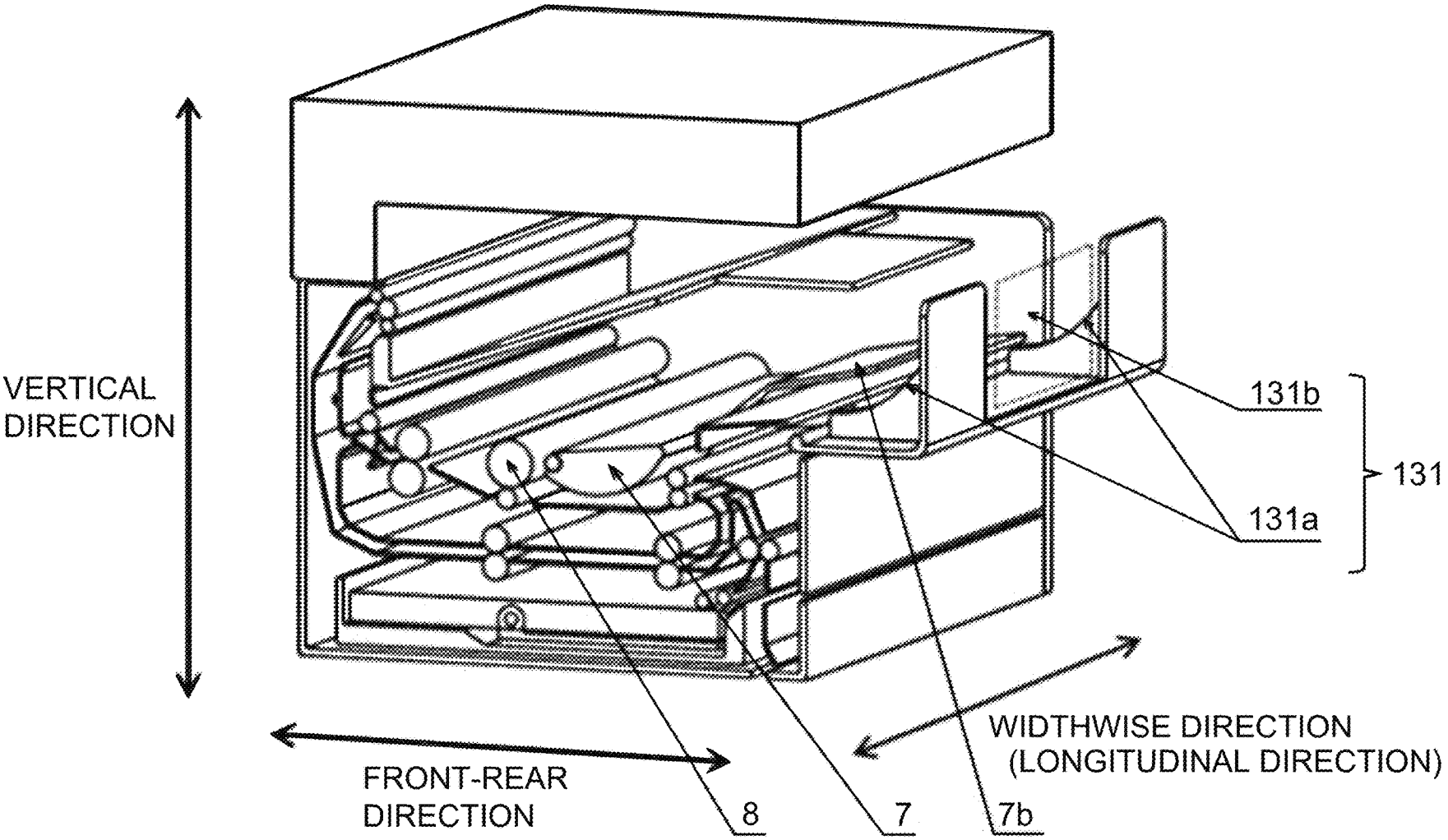
FIG. 3 is a perspective view showing a structure relating to a door portion in the First Embodiment.

FIG. 1 is a sectional view showing a general structure of an image forming apparatus according to a First Embodiment of the present invention. FIG. 3 is a perspective view showing a structure relating to a door portion in this embodiment. In order to simplify the following description, herein, several directions will be defined as follows. A direction parallel to a rotational axis direction of a photosensitive drum 8 as an image forming process means is a first direction. The first direction corresponds to a cartridge main body portion 7*a* of a developing cartridge 7 including a developer carrying member (developing roller) and corresponds to a longitudinal direction of the cartridge 7. Further, a direction perpendicular to the first direction is a second direction, and the second direction corresponds to a direction in which a grip portion 7*b* of the cartridge 7 is extended.

Further, a front-rear direction is a direction perpendicular to a longitudinal direction (widthwise direction) of the above-described cartridge in a horizontal plane, and a vertical direction is a direction perpendicular to the longitudinal direction (widthwise direction) and the front-rear direction.

In FIG. 1, sheet materials 1 as recording materials (recording papers) are stacked in a feeding tray 2. When a print job signal is sent from an unshown host computer connected to an image forming apparatus main assembly 16, a feeding roller 3 provided in the apparatus main assembly 16 is rotated, so that uppermost paper (sheet) of the sheet materials 1 stacked in the feeding tray 2 is fed.

The sheet material 1 guided by a feeding guide 4 is fed by a feeding roller pair 5 to a transfer nip (transfer portion) described below while being timed to image information formed on the photosensitive drum 8 in the cartridge 7 by a scanner unit 6. That is, the sheet material 1 is fed to the transfer nip formed by the photosensitive drum 8 and a transfer roller 9. During that period, an electrostatic latent image is developed into a toner image on the photosensitive drum 8. A transfer process is performed by a transfer bias applied to the transfer roller 9, so that the toner image formed on a surface of the photosensitive drum 8 is transferred onto the sheet material 1.

The sheet material after the transfer process is conveyed to a fixing device 10 and a fixing process is performed by heat and pressure, so that the toner image is fixed on the sheet material 1. After the fixing process, the sheet material 1 is discharged and stacked on a sheet discharge tray 12 by a sheet discharging roller pair 11.

Here, the cartridge 7 including process means for forming the toner image is provided so as to be mounting in and dismountable form the apparatus main assembly in a direction crossing the first direction. Further, the cartridge 7 is provided with a main body portion 7*a* having an image forming function, i.e., including the process means and provided with a grip portion 7*b* accessed (gripped) by a user when the user mounts and dismounts the cartridge 7. Further, the main body portion 7*a* and the grip portion 7*b* are provided at positions spaced (separated) from each other in the front-rear direction. Here, the grip portion 7*b* is positioned on a side downstream of the main body portion 7*a* when the cartridge 7 is separated and dismounted from an image forming position.

In FIG. 1, a front door 131 as a door portion provided to the apparatus main assembly 16 is provided openably relative to the apparatus main assembly 16 by rotation thereof. That is, the front door 131 is provided as a constitution (structure) in which the user performs an opening and closing operation so that an opening provided in the apparatus main assembly 16 is in a closed state during image formation and in an open state during mounting and dismounting of the cartridge 7. Further, the front door 131 in the open state is, as shown in FIG. 3, provided with a guiding portion 131 having a guiding surface for guiding a bottom (portion) of the cartridge 7 at each of end portions with respect to the widthwise direction (longitudinal direction) of the cartridge 7 is provided.

Further, the front door 131 is provided with an opening 131*b* (dotted line portion) as a user operating space for permitting the user to have access to the grip portion 7*b* of the cartridge 7 at a central portion with respect to the widthwise direction (longitudinal direction) of the cartridge 7. By providing the opening 131*b* (dotted line portion) at the central portion between the guiding portions provided at both end portions (in a region of 70 mm-280 mm (70 mm or more and 280 mm or less) from one longitudinal end), a constitution in which the user easily grips (holds) the grip portion 7*b* by his (her) hand(s) and has easy access to the grip portion 7*b* is provided.

(Guiding Portion at Door Portion)

The door portion in this embodiment is provided with the guiding portion 131*a* for guiding the cartridge 7. That is, as seen in the first direction, the guiding portion 131*a* having a guiding surface for guiding the cartridge 7 so that an extending direction of the grip portion 7*b* approaches a vertical direction with movement of the cartridge 7 in a dismounting direction more than the extending direction of the grip portion 7*b* when the cartridge 7 is in the image forming position is. Further, this guiding surface guides the cartridge 7 so that the grip portion 7*b* is positioned above the main body portion 7*a* with respect to the vertical direction before the cartridge 7 is separated from a downstream end of the guiding surface with respect to the dismounting direction of the cartridge 7.

Figure 7:
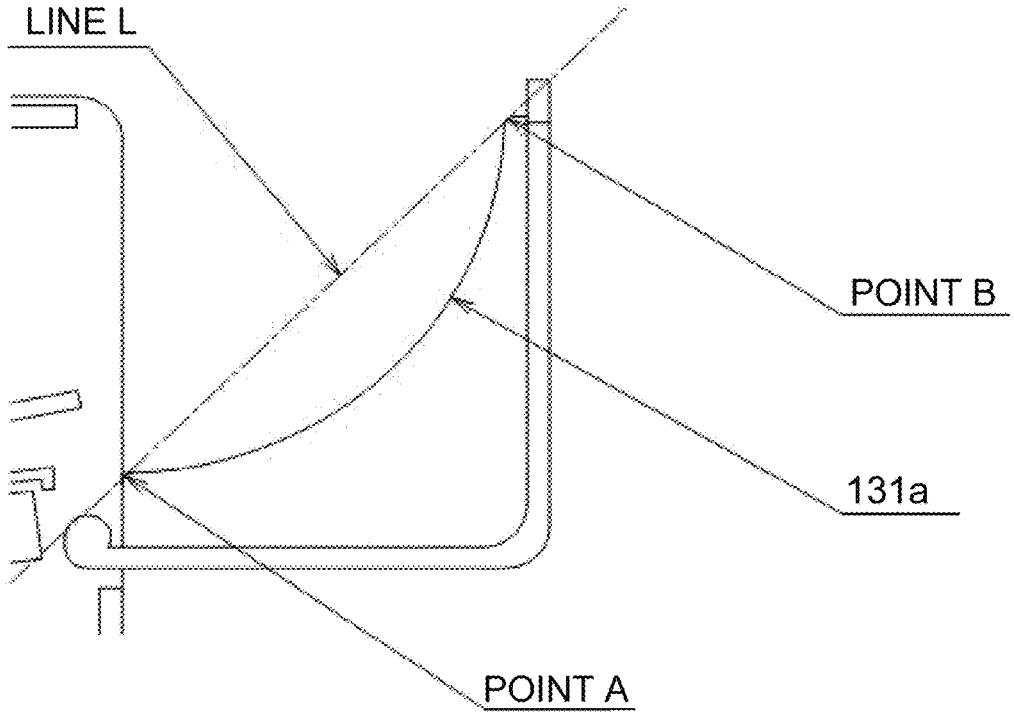
FIG. 7 is a sectional view of a guiding portion as seen in a longitudinal direction of the cartridge of the First Embodiment.

FIG. 7 is a sectional view of the guiding portion 131*a*, for guiding the cartridge 7, of the front door 131 (FIGS. 1 and 3) as a door portion in this embodiment as seen in the longitudinal direction of the cartridge 7.

Here, when the user pulls out (dismounts) the cartridge 7 in a first attitude at a position (image forming position) where the cartridge 7 is mounted in the apparatus main assembly 16, a point where the guiding portion 131*a* first contacts the cartridge 7 is a first point A (first position). Further, an attitude of the cartridge 7 at this time is an intermediary attitude. Further, a point where the cartridge 7 and the guiding portion 131*a* are first separated from each other is a second point B (second position), and the attitude of the cartridge 7 at this time (i.e., the attitude inclined relative to the first attitude) is a second attitude.

When a rectilinear line (chain line) connecting the first point A and the second point B is L, in this embodiment, the guiding portion 131*a* for guiding the bottom of the cartridge 7 is provided with the guiding surface so as to be a curved surface having a downwardly recessed shape relative to the rectilinear line L with respect to the vertical direction. The guiding portion 131*a* is a curved surface where a direction of being separated from the cartridge 7 forms a projection in a cross-section perpendicular to the first direction.

Figure 4:
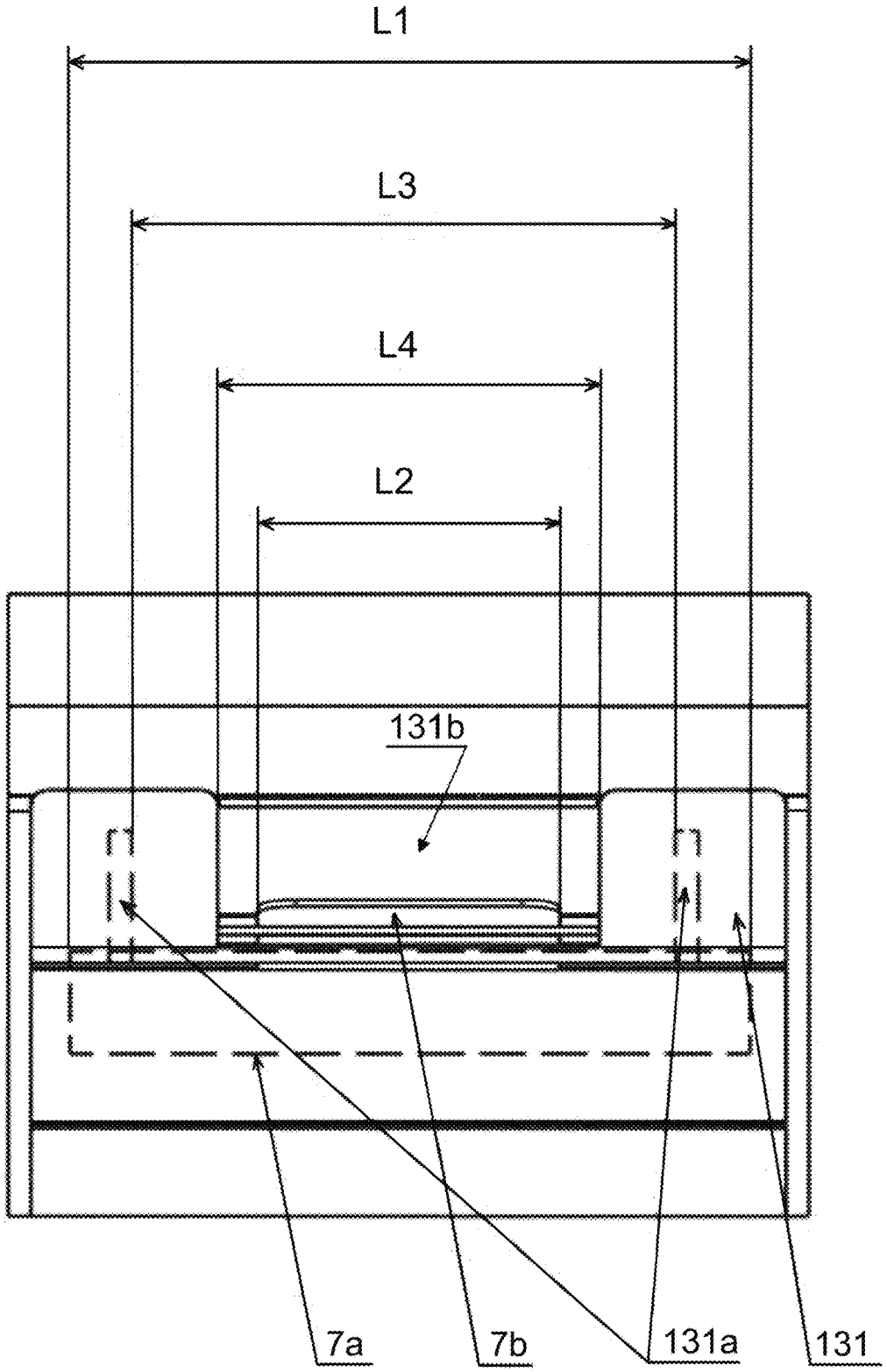
FIG. 4 is a front view showing a structure in the First Embodiment.
Figure 5:
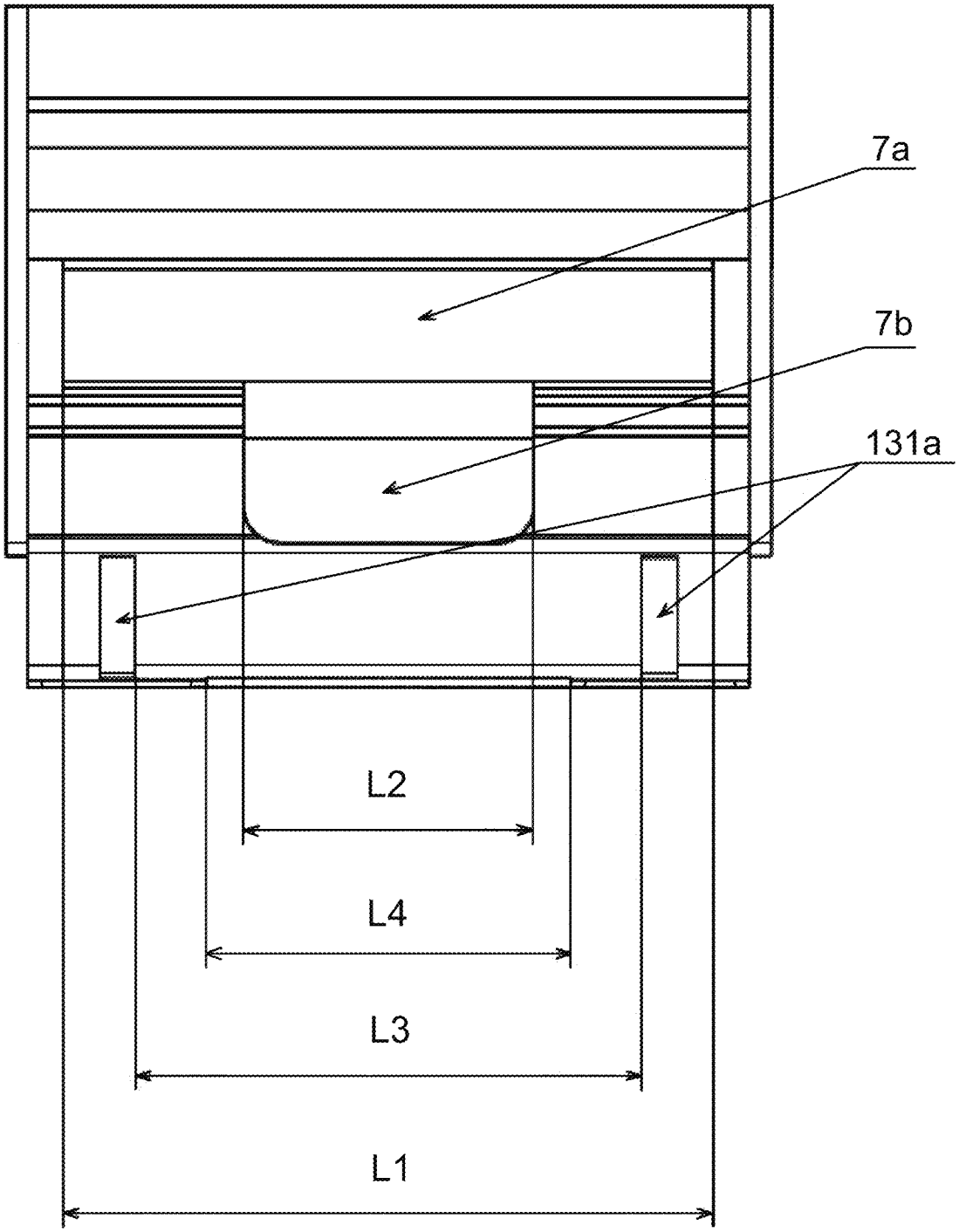
FIG. 5 is a top view showing a structure in the First Embodiment.

FIG. 4 is a front view showing a structure of the front door 131 as the door portion in this embodiment. Further, FIG. 5 is a top view showing the structure of the front door 131 as the door portion in this embodiment. Using these figures, relationships among lengths of respective portions with respect to the longitudinal direction (widthwise direction) will be described. A width L4 of the opening 131*b* as the user operating space is set at a size such that user's hand(s) easily enter(s) the apparatus main assembly. Further, a width L2 of the grip portion 7*b* is set so as to be smaller than the width L4 of the opening 131*b*. Further, an interval L3 between the guiding portions 131*a* is set so as to be larger than the width L4 of the opening 131*b* and so as to be smaller than a full length (full width) L1 of the cartridge 7.

By employing such a constitution, it is possible to provide an image forming apparatus which compatibly realize usability of the cartridge 7 and a reduction in height of the apparatus main assembly.

Figure 6:
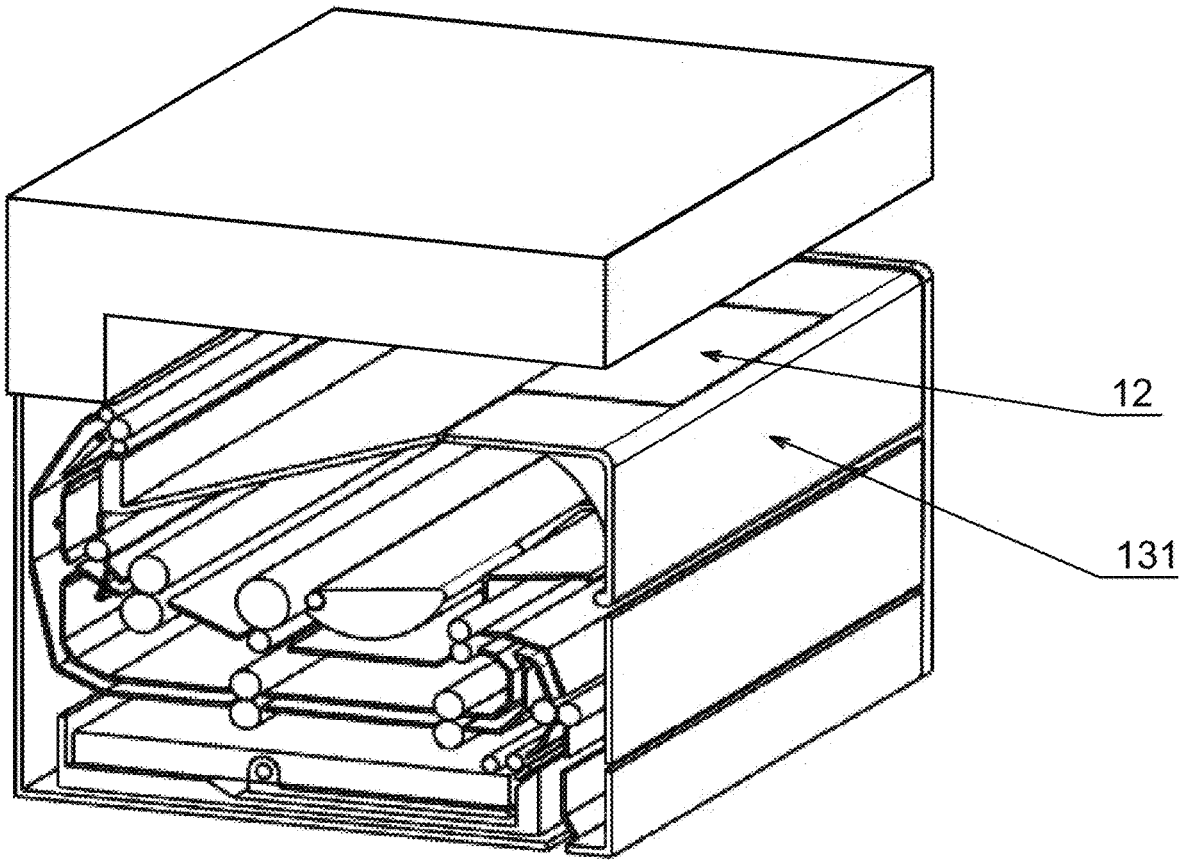
FIG. 6 is a perspective view in the case where the door portion in the First Embodiment is a closed state.

FIG. 6 is a perspective view in the case where the front door 131 as the door portion in this embodiment is in a closed state. In FIG. 16, the front door 131 is provided integrally with the discharge tray 12 provided as an upper cover so as to form an outer casing surface. As a result, it is possible to provide an image forming apparatus which compatibly realizes usability and designability of an outer casing.

Figure 2:
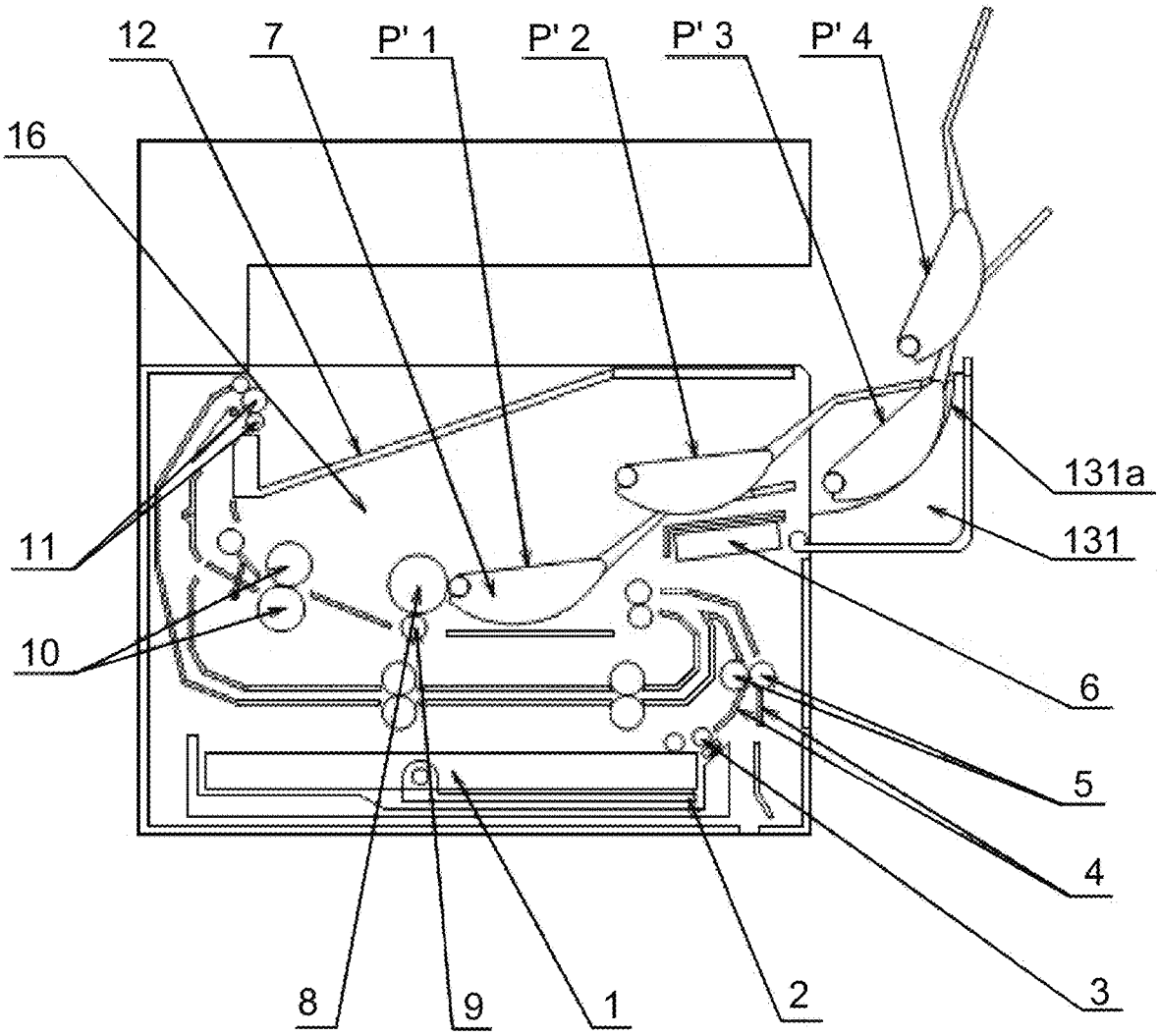
FIG. 2 is a sectional view showing a process in which a cartridge is pulled out (dismounted) from an image forming apparatus main assembly in the image forming apparatus of the First Embodiment of the present invention.

FIG. 2 is a sectional view showing a process of portioning out the cartridge 7 of the image forming apparatus of this embodiment. The cartridge 7 is pulled out (dismounted) in a direction of P'1, P'2, P'3 and P'4 (in a named order) in FIG. 2. In this case, as described above, based on a shape of the guiding portions 131*a* of the front door 131, the cartridge 7 is rotated in a process of P'2, P'3 and P'4. As a result, at the time when the cartridge 7 is separated from the front door 131, the grip portion 7*b* is positioned on a side upstream of the main body portion 7*a* with respect to the vertical direction.

For this reason, drop of the cartridge 7 by the user is suppressed without causing operation (rotation) from P3 to P4 at the time after the cartridge 7 is separated from the front door 134 in a conventional example described above with reference to FIG. 14. As a result, it is possible to provide an image forming apparatus which compatibly realizes a reduction in height (with respect to the vertical direction) of the apparatus main assembly 16 and usability of mounting and dismounting of the cartridge 7. That is, even in the case where the cartridge 7 is made thin, an image forming apparatus from which the cartridge 7 is pulled out without being dropped can be provided.

Figure 14:
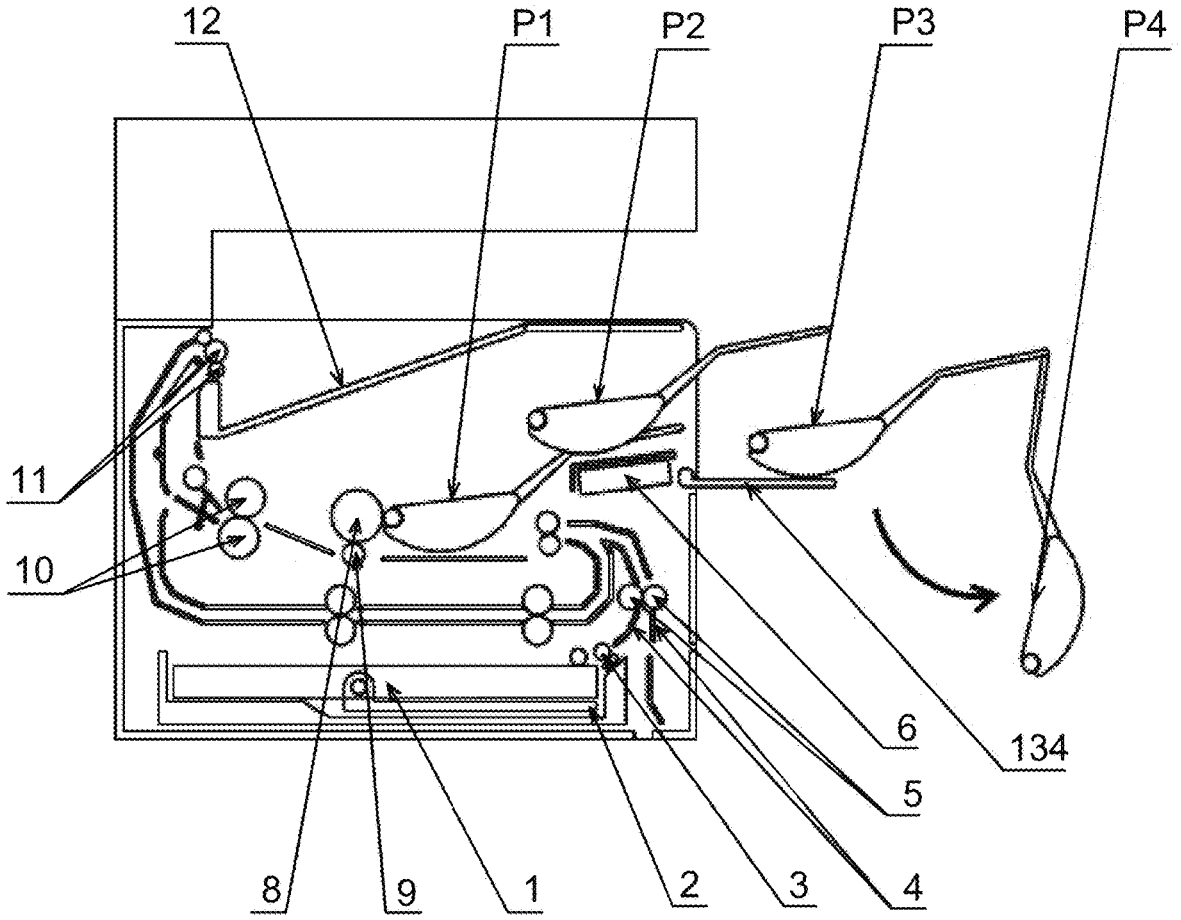
FIG. 14 is a sectional view showing a process in which a cartridge is pulled out (dismounted) from the conventional image forming apparatus.

Incidentally, in the above, the case of dismounting the cartridge 7 from the apparatus main assembly 16 was described, but according to the constitution of this embodiment, contrarily, when the cartridge 7 is mounted in the apparatus main assembly 16, a rotational load from P3 to P4 of FIG. 14 in the conventional example can be alleviated.

Second Embodiment

Figure 8:
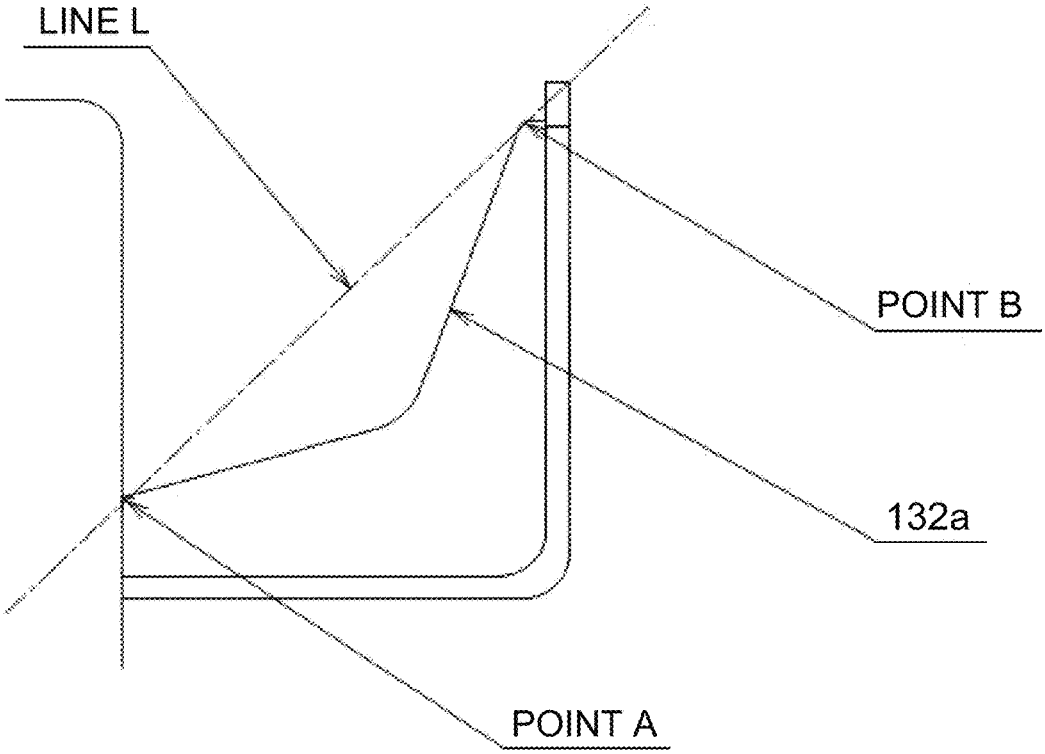
FIG. 8 is a sectional view of a guiding portion as seen in a longitudinal direction of a cartridge of a Second Embodiment.

In the First Embodiment, a constitution in which a curved shape (flexed shape) is used as the shape of the guiding portion 131*a* as seen in the longitudinal direction of the cartridge 7 as shown in FIG. 7 was employed, but in this embodiment, a constitution using a plurality of rectilinear lines representing guiding portions 132*a* shown in FIG. 8 is employed.

In this case, when the user pulls out the cartridge 7, compared with the First Embodiment, a slight change in operating force occurs. However, similarly as in the First Embodiment, the attitude of the cartridge 7 is changed, so that when the cartridge 7 is finally separated from the guiding portions 132*a*, the grip portion 7*b* can be positioned on a side above the main body portion 7*a* with respect to the vertical direction.

As a result, drop of the cartridge 7 by the user can be suppressed without causing operation (rotation) from P3 to P4 at the time after the cartridge 7 is separated from the front door 134 in the conventional example described above with reference to FIG. 14. As a result, it is possible to provide an image forming apparatus which compatibly realizes a reduction in height (with respect to the vertical direction) of the apparatus main assembly 16 and usability of mounting and dismounting of the cartridge 7. That is, even in the case where the cartridge 7 is made thin, an image forming apparatus from which the cartridge 7 is pulled out without being dropped can be provided.

Incidentally, in the above, the case of dismounting the cartridge 7 from the apparatus main assembly 16 was described, but according to the constitution of this embodiment, contrarily, when the cartridge 7 is mounted in the apparatus main assembly 16, a rotational load from P3 to P4 of FIG. 14 in the conventional example can be alleviated.

Third Embodiment

Figure 9:
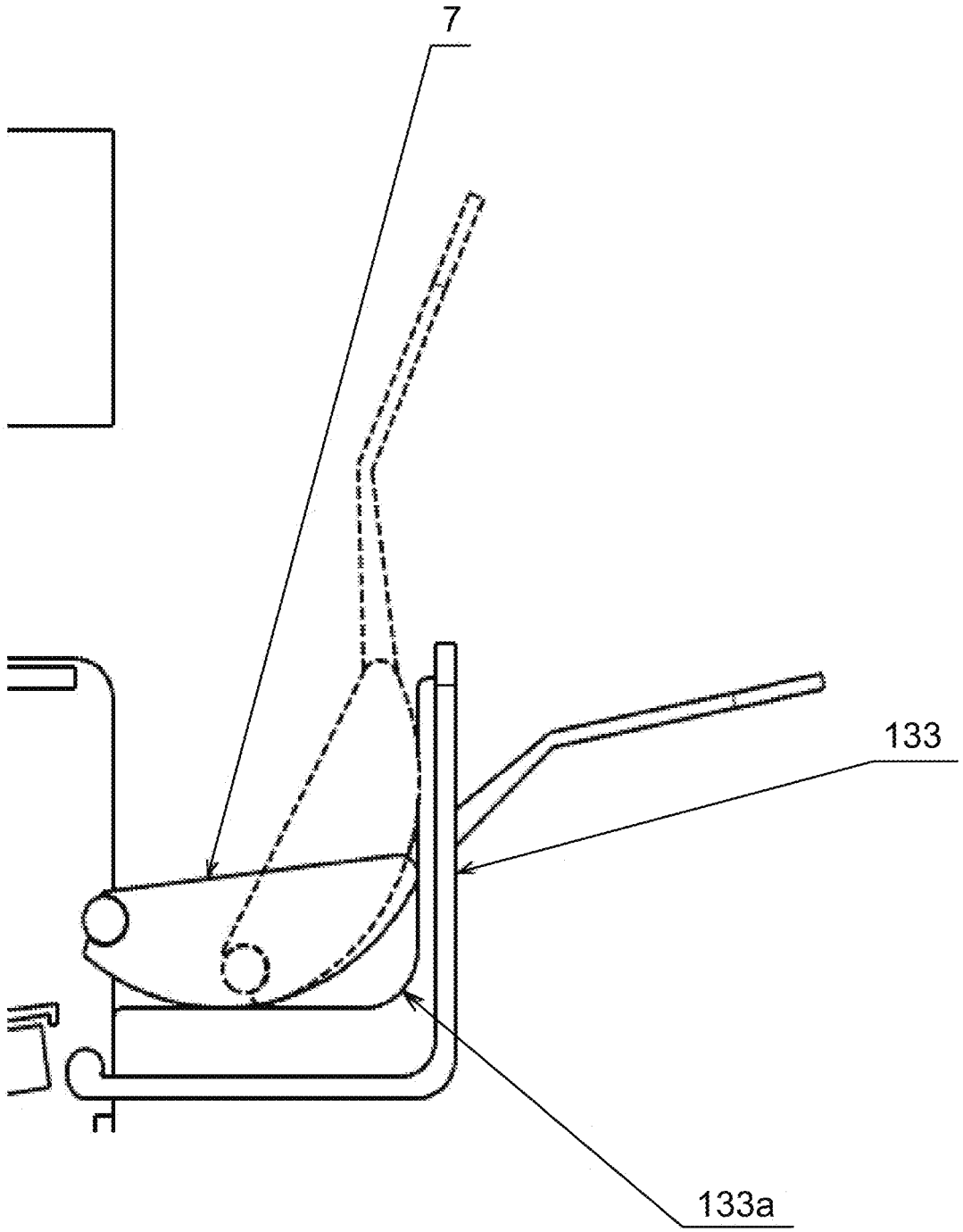
FIG. 9 is a sectional view of a guiding portion as seen in a longitudinal direction of a cartridge of a Third Embodiment.

As a modified embodiment of the Second Embodiment, in this embodiment, as seen in the longitudinal direction of the cartridge 7 as shown in FIG. 9, a constitution using guiding portions 133*a* having an extremely recessed shape (L-shape) is employed.

In this case, when the user pulls out the cartridge 7, the cartridge 7 interferes with the guiding portions 133*a*, so that the user himself (herself) changes the attitude of the cartridge 7 from a solid-line attitude to a broken-line attitude. Also in this embodiment, a purpose such that when the cartridge 7 is separated from the guiding portions 133*a*, the grip portion 7*b* is positioned on the side above the main body portion 7*a* with respect to the vertical direction can be achieved.

For this reason, drop of the cartridge 7 by the user is suppressed without causing operation (rotation) from P3 to P4 at the time after the cartridge 7 is separated from the front door 134 in the conventional example described above with reference to FIG. 14. As a result, it is possible to provide an image forming apparatus which compatibly realizes a reduction in height (with respect to the vertical direction) of the apparatus main assembly 16 and usability of mounting and dismounting of the cartridge 7. That is, even in the case where the cartridge 7 is made thin, an image forming apparatus from which the cartridge 7 is pulled out without being dropped can be provided.

Incidentally, in the above, the case of dismounting the cartridge 7 from the apparatus main assembly 16 was described, but according to the constitution of this embodiment, contrarily, when the cartridge 7 is mounted in the apparatus main assembly 16, a rotational load from P3 to P4 of FIG. 14 in the conventional example can be alleviated.

Fourth Embodiment

In the First to Third Embodiments, the guiding portions provided on the door portion in an open state guided the bottom of the cartridge 7 on a lower side of the cartridge 7 with respect to the vertical direction. On the other hand, in this embodiment, guiding portions guide side end portions of the cartridge 7 with respect to the longitudinal direction.

Figure 10:
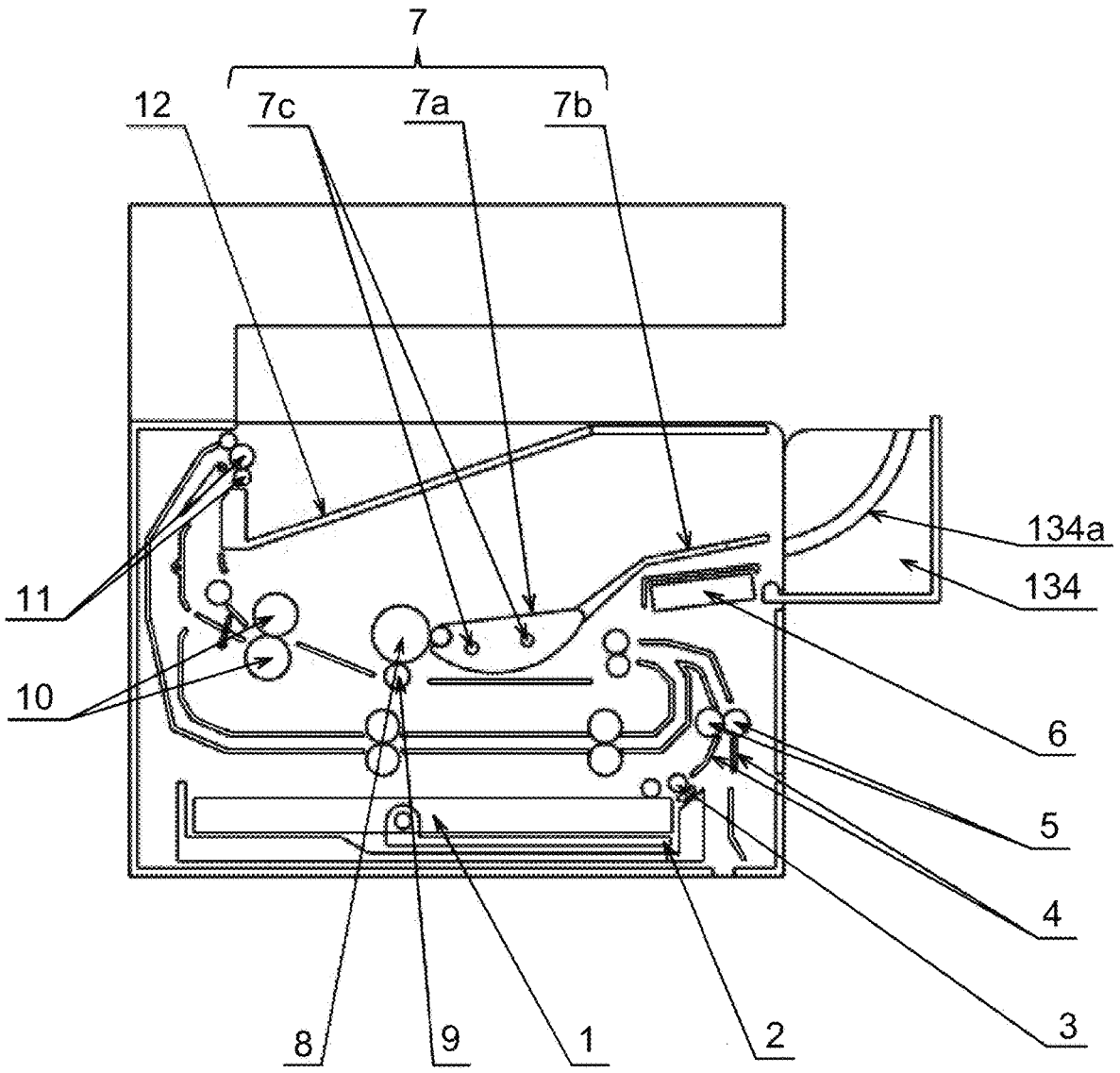
FIG. 10 is a sectional view of an image forming apparatus including a guiding portion as seen in a longitudinal direction of a cartridge of a Fourth Embodiment.
Figure 11:
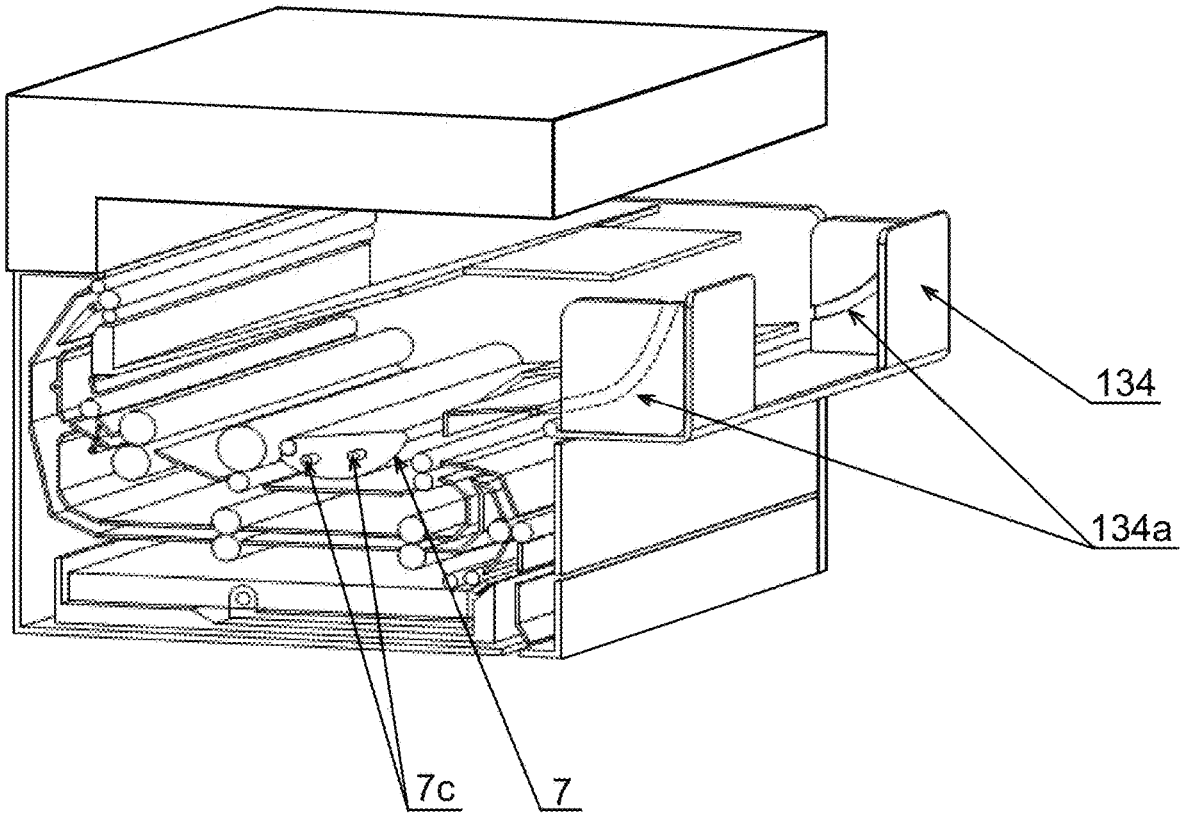
FIG. 11 is a perspective view showing a structure in the Fourth Embodiment.

That is, in this embodiment, as shown in FIGS. 10 and 11, at each of end portions of the main body portion 7*a* with respect to the widthwise direction (longitudinal direction), a single or a plurality of boss portions 7*c* as projected portions are provided. Further, guiding portions 134*a* are provided with recessed portions corresponding to the boss portions 7*c* provided at the side end portions of the main body portion 7*a* with respect to the longitudinal direction of the cartridge 7. That is, each of the recessed portions provided in the guiding portion 134*a* is provided in a continuous groove shape, and specifically, as seen in the longitudinal direction of the cartridge 7, any of the shapes (FIGS. 7, 8 and 9) described in the First to Third Embodiments can be used.

Figure 12A:
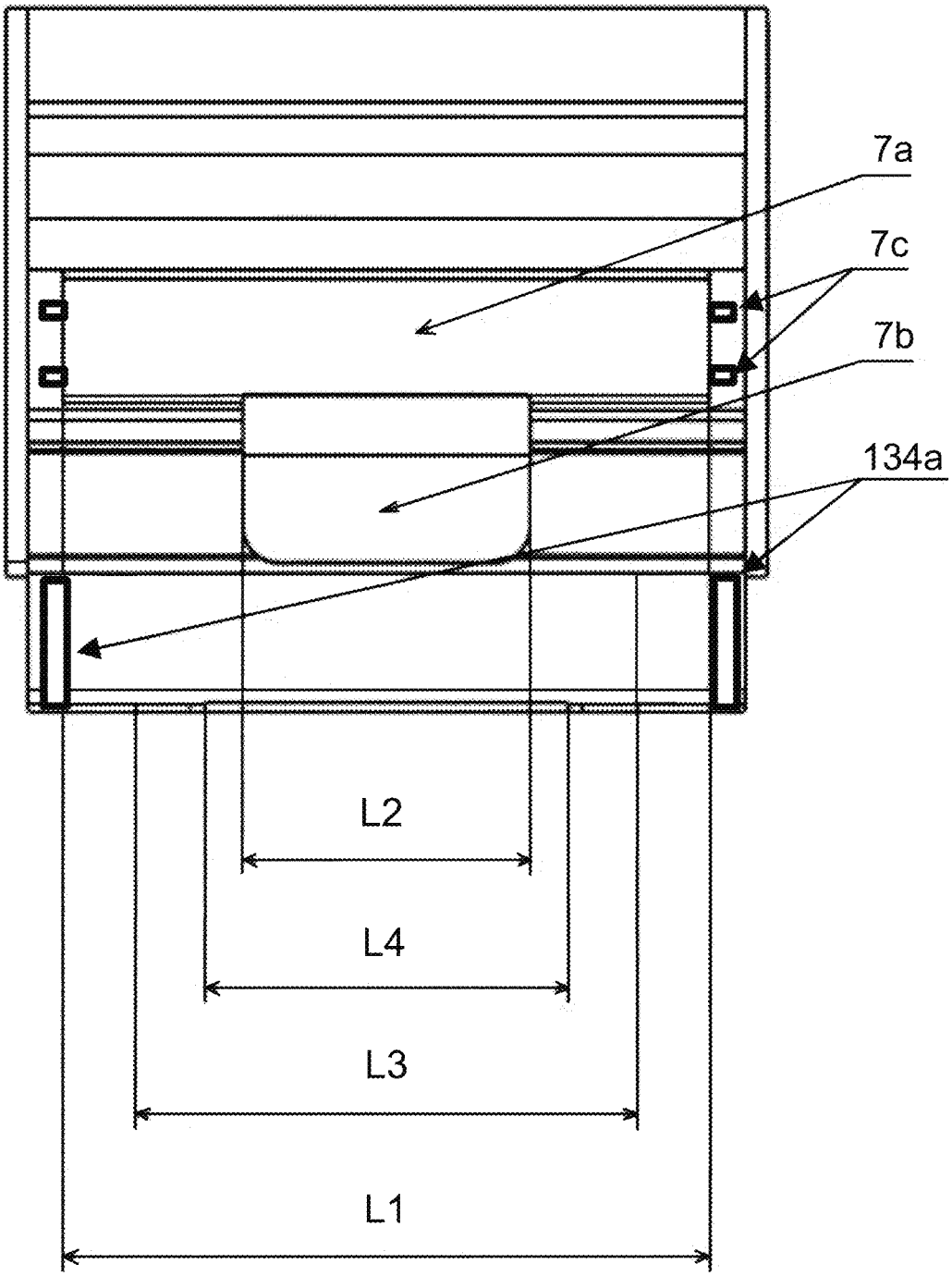
FIG. 12A is a top view showing the structure in the Fourth Embodiment.

In this embodiment, when the user pulls out the cartridge 7, the boss portions 7*c* are guided by the guiding portions 134*a*, so that the attitude of the cartridge 7 is uniquely determined compared with the First Embodiment. That is, with respect to the longitudinal direction of the cartridge 7, an interval between the guiding portions 134*a* shown in FIG. 12A functions as a regulating portion for regulating the widthwise direction (longitudinal direction) of the main body portion 7*a*.

Further, irrespective of an operating method of the user, positioning of the grip portion 7*b* on the side above the main body portion 7*a* with respect to the vertical direction can be achieved with further high accuracy when the cartridge 7 is separated from the guiding portions 134*a*.

Thus, according to this embodiment, when the user takes the cartridge 7 out of the apparatus main assembly 16, a locus of the cartridge 7 is uniquely determined, so that an image forming apparatus from which the user does not drop can be provided.

Incidentally, in the above, the case of dismounting the cartridge 7 from the apparatus main assembly 16 was described, but according to the constitution of this embodiment, contrarily, when the cartridge 7 is mounted in the apparatus main assembly 16, a rotational load from P3 to P4 of FIG. 14 in the conventional example can be alleviated.

Fifth Embodiment

In the Fourth Embodiment, a constitution in which as portions for guiding the side end portions of the cartridge 7 with respect to the longitudinal direction, the boss portions 7*c* as the projected portions are provided on the main body portion 7*a* and the guiding portions 134*a* are provided with the recessed portions corresponding to the projected portions was employed. In this embodiment, an uneven constitution opposite in arrangement from the Fourth Embodiment is employed.

Figure 12B:
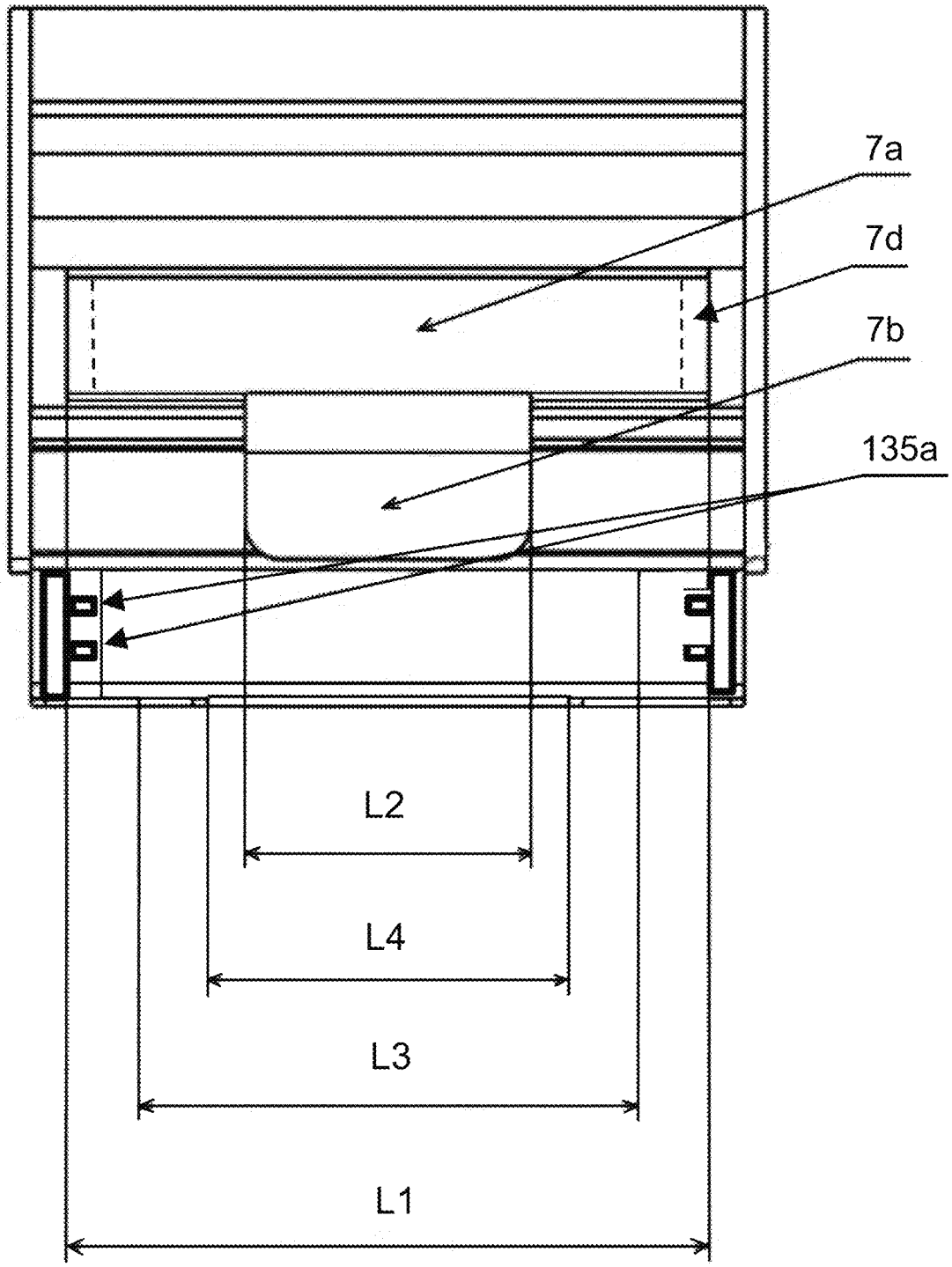
FIG. 12B is a top view showing a structure in a Fifth Embodiment in which an uneven structure in the Fourth Embodiment is reversed.
Figure 13:
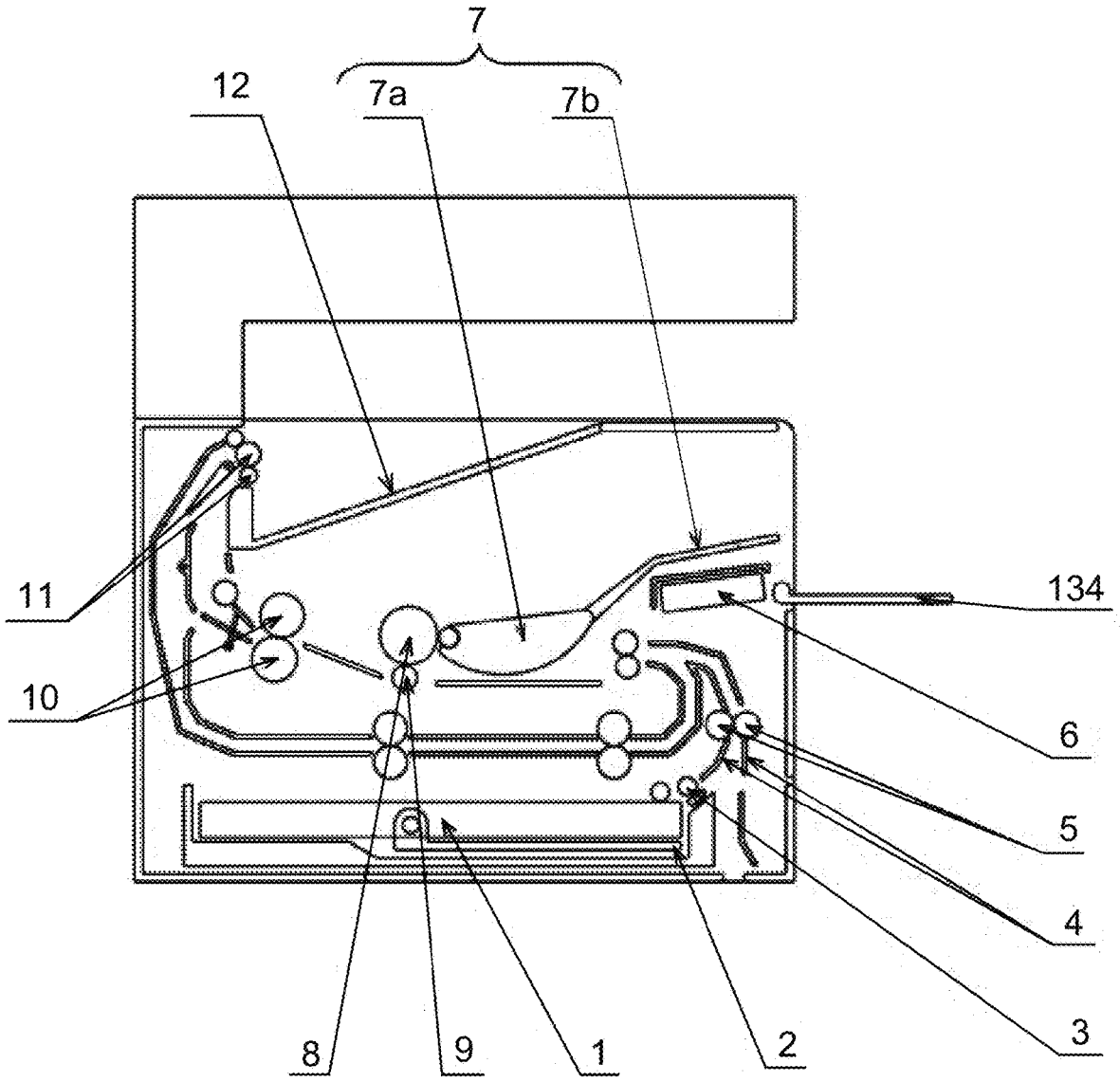
FIG. 13 is a sectional view showing a structure of a conventional image forming apparatus.

That is, in this embodiment, as shown in FIG. 12B on each side of the cartridge 7 with respect to the longitudinal direction, a single or a plurality of boss portions as projected portions are provided to each of guiding portions 135*a*. Further, the main body portion 7*a* has continuous groove-shaped portions 7*d* as recessed portions provided at the side end portions thereof with respect to the longitudinal direction of the cartridge 7. Specifically, as seen in the longitudinal direction of the cartridge 7, any of the shapes (FIGS. 7, 8 and 9) described in the First to Third Embodiments can be used.

In this embodiment shown in FIG. 12B, when the user pulls out the cartridge 7, the boss portions of the guiding portions 135*a* and guided by the recessed portions (continuous groove-shaped portions) 7*d* provided at the side end portions with respect to the longitudinal direction of the cartridge 7. As a result, the attitude of the cartridge 7 is uniquely determined compared with the First Embodiment. That is, with respect to the longitudinal direction of the cartridge 7, an interval L1 between the guiding portions 135*a* shown in FIG. 12B functions as a regulating portion for regulating the widthwise direction (longitudinal direction) of the main body portion 7*a*.

Further, irrespective of an operating method of the user, positioning of the grip portion 7*b* on the side above the main body portion 7*a* with respect to the vertical direction can be achieved with further high accuracy when the cartridge 7 is separated from the guiding portions 135*a*.

Thus, according to this embodiment, when the user takes the cartridge 7 out of the apparatus main assembly 16, a locus of the cartridge 7 is uniquely determined, so that an image forming apparatus from which the user does not drop can be provided.

Incidentally, in the above, the case of dismounting the cartridge 7 from the apparatus main assembly 16 was described, but according to the constitution of this embodiment, contrarily, when the cartridge 7 is mounted in the apparatus main assembly 16, a rotational load from P3 to P4 of FIG. 14 in the conventional example can be alleviated.

Modified Embodiments

In the above-described embodiments, preferred embodiments of the present invention were described, but the present invention is not limited thereto, and various modifications can be made within the scope of the present invention.

Modified Embodiment 1

In the above-described embodiments, as the cartridge, the developing cartridge including the developer carrying member (developing roller) was described, but the present invention is also applicable to a drum cartridge including the photosensitive drum. Further, as the cartridge, the present invention is applicable to a process cartridge integrally including the developer carrying member (developing roller) and the photosensitive drum.

That is, in the image forming apparatus provided with a cartridge including the image forming apparatus main assembly provided with at least the transfer roller of the members consisting of the photosensitive drum and the transfer roller which form the transfer nip where the toner image is transferred and including the process means for forming the toner image, the following cases would be considered. That is, the case where the image forming apparatus main assembly includes the photosensitive drum, and the case where the cartridge includes the photosensitive drum as the process means.

Modified Embodiment 2

In the above-described embodiments, as shown in FIG. 6, a constitution in which in the closed state of the door portion, the outer casing surface is formed by the discharge tray 12 and the front door 131 (i.e., the outer casing surface is formed by rear plates for supporting the guiding portions on both sides between which the discharge tray 12 is sandwiched and by the discharge tray 12) in combination. However, a constitution in which the rear plates supporting the guiding portions do not form the outer casing surface may also be employed.

Modified Embodiment 3

In the above-described embodiments, the image forming apparatus including an S-shaped path (S path) as a recording material feeding path from the feeding roller 3 to the discharge roller pair 11 was described, but the present invention is also similarly applicable to a C-shaped path (C path).

Further, in the above-described embodiments, the image forming apparatus in which the image scanner 15 was provided was described, but the present invention is also similarly applicable to an image forming apparatus with no image scanner 15.

Modified Embodiment 4

In the above-described embodiments, as the recording material, the recording paper was described, but the recording material is not limited to the paper. In general, the recording material is a sheet-like member on which the toner image is formed by the image forming apparatus, and for example, includes regular-shaped or irregular-shaped recording materials, such as plain paper, thick paper, thin paper, envelopes, postcards, seals, resin sheets, OHP sheets and glossy paper. Incidentally, in the above-described embodiments, for convenience, handling of the recording material (sheet) was described using terms such as sheet (paper) discharge, but by this, the recording material in the present invention is not limited to the paper.

Modified Embodiment 5

In the above-described embodiments, the toner image was transferred onto the sheet material 1 as the recording material at the transfer nip, but the toner image may also be transferred onto an intermediary transfer belt as an intermediary transfer member at the transfer nip and then is transferred onto the recording material at a secondary transfer portion.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-096163 filed on May 18, 2018, which is hereby incorporated by reference herein in its entirety.

What is claimed is:

1. An image forming apparatus comprising:

a photosensitive member configured to carry a toner image;

a cartridge including a developing member configured to supply toner to said photosensitive member, a frame configured to support said developing member so that said developing member is rotatable, and a grip portion provided on said frame; and a main assembly configured so that said cartridge is mountable in and dismountable from said main assembly in a direction crossing a rotational axis direction of said developing member, wherein said main assembly includes an opening through which said cartridge passes when said cartridge is mounted in and dismounted from said main assembly and includes an openable member rotatable between an open position where said opening is not covered by the openable member and a closing position where said opening is closed by the openable member, wherein said grip portion of said cartridge extends in a direction along a dismounting direction of said cartridge from said main assembly in a state in which said cartridge is mounted in said main assembly, wherein said openable member includes a guiding portion configured to support said cartridge from below and guide said cartridge while said cartridge is being dismounted from said main assembly when said openable member is in the open position, and wherein said guiding portion includes a guiding surface having a downwardly recessed shape on a cross-section perpendicular to the rotational axis direction, the guiding surface being configured to guide said cartridge so that an extending direction of said grip portion approaches a vertical direction as the cartridge is moved in the dismounting direction.

2. An image forming apparatus according to claim 1, wherein when said openable member is viewed in the dismounting direction, a recessed portion recessed downwardly is provided at a central portion of said openable member with respect to the rotational axis direction, and wherein said guiding portion is provided at each of end portions of said openable member.

3. An image forming apparatus according to claim 2, wherein said recessed portion has a width of 70 mm or more and 280 mm or less with respect to the rotational axis direction.

4. An image forming apparatus according to claim 1, wherein said cartridge is constituted so as to be mounting in and dismountable from said main assembly in a state in which said photosensitive member is in said main assembly.

5. An image forming apparatus according to claim 1, wherein the guiding surface is a curved surface on the cross section.

6. An image forming apparatus according to claim 1, wherein the guiding surface includes two flat surfaces, and wherein a distance between the two flat surfaces of the guiding surface increases as they extend upward.

* * * * *